US006588510B2

(12) United States Patent
Card et al.

(10) Patent No.: US 6,588,510 B2
(45) Date of Patent: Jul. 8, 2003

(54) COIL TUBING HANGER SYSTEM

(75) Inventors: Gary A. Card, Bakersfield, CA (US); Robert K. Meek, Bakersfield, CA (US)

(73) Assignee: Duhn Oil Tool, Inc., Bakersfield, CA (US)

( * ) Notice: Subject to any disclaimer, the term of this patent is extended or adjusted under 35 U.S.C. 154(b) by 46 days.

(21) Appl. No.: 09/954,354

(22) Filed: Sep. 17, 2001

(65) Prior Publication Data

US 2003/0051884 A1 Mar. 20, 2003

(51) Int. Cl.[7] ..... E21B 23/00

(52) U.S. Cl. ..... 166/382; 166/384; 166/89.3; 166/88.2; 166/75.13; 166/77.2; 166/85.1; 166/85.5; 166/86.1; 166/88.3

(58) Field of Search ..... 166/382, 384, 166/75.13, 77.2, 85.1, 85.5, 86.1, 88.2, 88.3, 89.3

(56) References Cited

U.S. PATENT DOCUMENTS

| | | | | |
|---|---|---|---|---|
| 2,788,073 A | | 4/1957 | Brown | 166/78 |
| 3,494,638 A | | 2/1970 | Todd et al. | 285/93 |
| 4,646,827 A | | 3/1987 | Cobb | 166/88 |
| 5,036,927 A | | 8/1991 | Willis | 175/162 |
| 5,092,400 A | | 3/1992 | Jagert | 166/88 |
| 5,431,230 A | | 7/1995 | Land et al. | 166/369 |
| 5,467,825 A | | 11/1995 | Vallet | 166/379 |
| 5,515,925 A | | 5/1996 | Boychuk | 166/379 |
| 5,515,926 A | | 5/1996 | Boychuk | 166/379 |
| 5,544,706 A | | 8/1996 | Reed | 166/379 |
| 5,727,631 A | | 3/1998 | Baker et al. | 166/379 |
| 5,794,693 A | | 8/1998 | Wright et al. | 166/85.5 |
| 5,875,841 A | | 3/1999 | Wright et al. | 166/85.4 |
| 5,988,273 A | | 11/1999 | Monjure et al. | 166/75.14 |
| 6,012,519 A | * | 1/2000 | Allen et al. | |
| 6,015,009 A | * | 1/2000 | Allen | |
| 6,192,981 B1 | * | 2/2001 | Boquet et al. | |

FOREIGN PATENT DOCUMENTS

| | | |
|---|---|---|
| CA | 896339 | 3/1972 |
| EP | 535277 | 4/1993 |

OTHER PUBLICATIONS

"RH" Series Coiled Tubing Hanger Systems, May 11, 1999, 2 Pages.
Wood Group Pressure Control, CoilLok Coiled Tubing Hanger Systems, 4 Pages.
Wellhead Control Products, Inc., Coiled Tubing Hanger Systems for Live Well Installations, 13 Pages, May 1999.
True Turn Machine, Tru–Set Coil Tubing Hanger, 3 Pages, Undated.
Flow Control Equipment, Inc., Hercules Polished Rod Accessories, Rod Rotators, 1 Page, 1997.
Cameron, Wellhead and Christmas Tree Assemblies, 1 Page, 1996–1997.
RODEC, Ultimate Tubing Rotators, 12 Pages, Undated.
RODEC, Auto–Turn Tubing Rotators, 9 Pages, Undated.

* cited by examiner

*Primary Examiner*—Roger Schoeppel
(74) *Attorney, Agent, or Firm*—Christie, Parker & Hale, LLP

(57) ABSTRACT

A coil tubing hanger system and a method of installing such system is provided. The coil tubing hanger system comprises a body having an axial opening there through. A slip bowl having a base and housing a slip that can be retained in a first position spaced apart from bowl base and a second position proximate the bowl base is fitted within the opening. The slip has inner teeth. Tubing is fitted within the slip and through the bowl while the slip is retained in the first position. The slip is then allowed to drop to the second position such that the slip teeth bite onto the outer surface of the tubing.

20 Claims, 6 Drawing Sheets

COIL TUBING HANGER SYSTEM

BACKGROUND OF THE INVENTION

The present invention is directed to a coil tubing hanger system and to a method of installing such system.

Coil tubing hanger systems are used to allow for coil tubing to be installed in a well. Slips are used to hold the coil tubing in place. Current coil tubing hanger systems require that their slips be installed through a window formed through a well tree. This exposes the operator installing the slips to well hazzards. Consequently, a coil tubing hanger system is desired that allow for the installation of the slips without exposing the operator to well hazzards.

SUMMARY OF THE INVENTION

A coil tubing hanger system and a method of installing such system is provided. The coil tubing hanger system comprises a body having a cylindrical opening there through. A slip bowl having a central opening through its base and housing a slip fitted within the opening. The slip has teeth formed on its inner surface and can be retained at a first position spaced apart from the bowl base by use of slip set screws penetrating the body, the slip bowl and slip. Tubing is fitted within the body cylindrical opening and through the bowl and slip while the slip is retained in a first position. The slip is allowed to drop toward the base of the bowl by retracting the slip set screws such that the slip teeth bite on the outer surface of the tubing.

DETAILED DESCRIPTION

Figure 1:
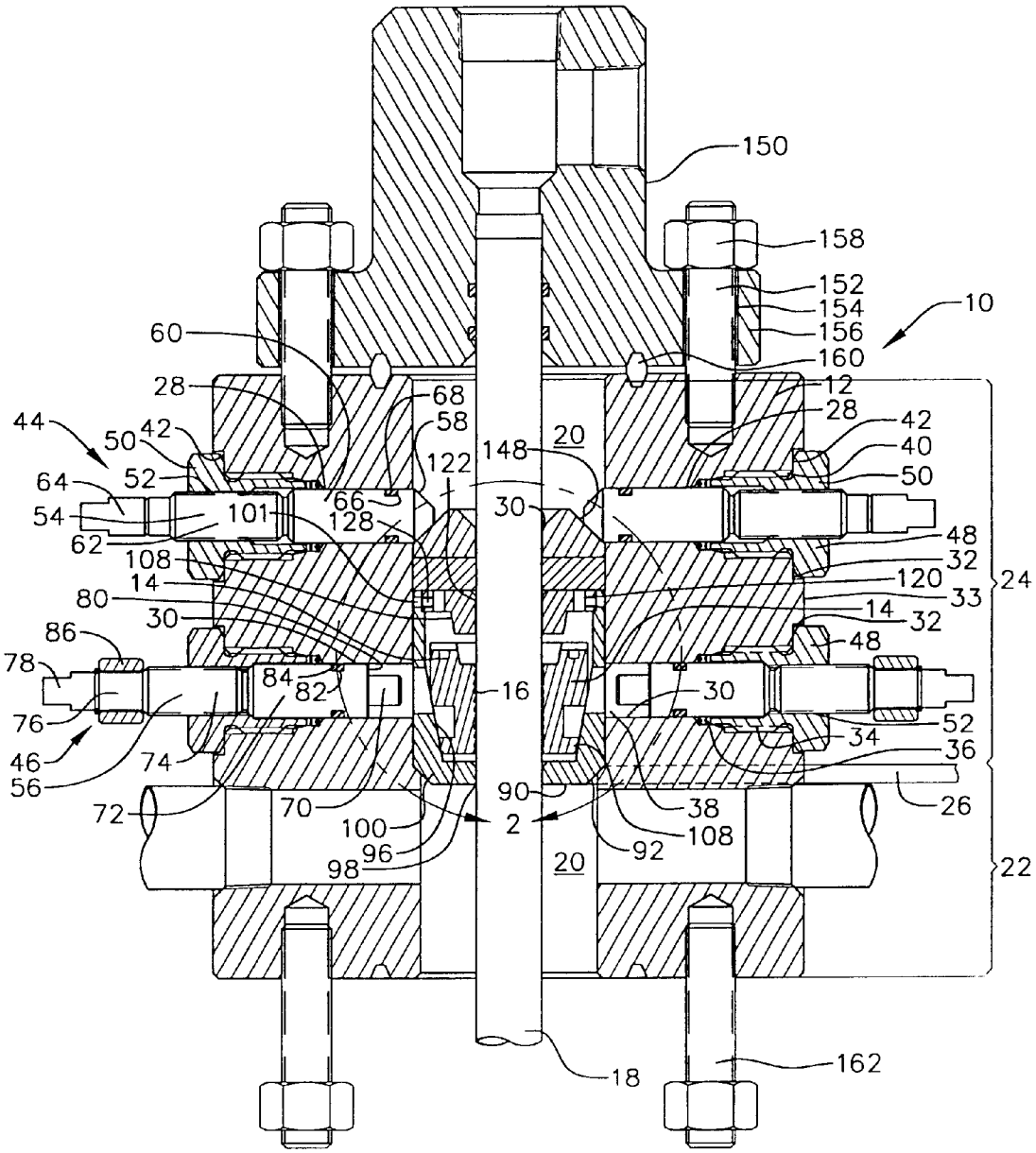
FIG. 1 is a cross-sectional view of an exemplary embodiment of the inventive coil tubing hanger system of the present invention.

The inventive coil tubing hanger system comprises a head 10 which includes a body 12, as well as a slip 14 having inner teeth 16 for biting onto coil tubing 18. The body has an axial central cylindrical passage 20 comprised of two sections. A lower section 22, which has a first diameter, and an upper section 24 extending coaxially from the lower section and having a second diameter greater than the diameter than the lower section. A section 26 of the opening between the two sections is tapered upwards in a radially outward direction. It should be noted that the terms "upper," "lower," "top," "bottom," "front" and "rear" are used for descriptive purposes and are not meant to denote precise locations.

In an exemplary embodiment system as shown in FIG. 1, a first set of transverse openings 28 is formed radially through the body in a direction perpendicular to the axial passage. These openings extend to an upper portion of the upper section 24 of the passage. In the exemplary embodiment shown in FIG. 1, four such openings are formed and are equidistantly spaced apart around the body.

A second set of openings 30 is formed radially through the body transverse to the axial passage and intersect the axial passage. In the exemplary embodiment shown in FIG. 1, four such openings are formed and are equidistantly spaced apart around the body. In the exemplary embodiment, the second set of openings are formed below the first set of openings. Each of the first and second set openings in the exemplary embodiment has four sections. The first section 32 extends to the outer surface 33 of the coil tubing head body. The second, third and fourth sections, 34, 36 and 38 respectively extend coaxially and sequentially from the first section in a radially inward direction. Each section has a diameter smaller than the diameter of its adjacent radially outward section. Consequently, the first section has the largest diameter of the four sections. An annular lip 40 is formed at the end of the second section proximate the first section. Furthermore an annular shoulder 42 is formed between the first and second sections of each opening.

Each of the first set of openings accommodates an energizing screw assembly 44 and each of the second set of openings accommodates a slip set screw assembly 46. In the exemplary embodiment shown in FIG. 1, each energizing screw assembly and each slip set screw assembly consists of a packing nut 48 which is threaded into a corresponding first or second set opening. The packing nut has a head 50 which mates against the shoulder 42 formed between the first and second sections of the openings when the packing nut is sufficiently inserted into the opening. Each packing nut also has a central axial opening 52 which is threaded.

Each energizing screw assembly also comprises an energizing screw 54, while each slip set screw assembly also comprises a slip set screw 56. Each energizing screw has a frusto-conical tip portion 58 from which extends a body portion 60 from which extends a threaded portion 62 from which extends a head 64. An annular groove 66 is formed on the body portion proximate the tip portion of each energizing screw. A seal, as for example an O-ring seal 68 is fitted within that groove. Alternatively, an annular groove is formed on the fourth section of each opening accommodating an energizing screw assembly and a seal is fitted in such groove. Each energizing screw assembly is threaded through a corresponding packing nut such that the threaded portion 62 of each energizing screw assembly threads to the packing nut threaded central opening 52.

A slip set screw 56 of each slip set screw assembly is threaded through its corresponding packing nut. Each slip set screw also includes a tip portion 70 from which extends a body portion 72 from which extends a threaded portion 74 from which extends an intermediate portion 76 from which extends a head 78. The threaded portion 74 is threaded to the axial opening thread of a corresponding packing nut. In the exemplary embodiment shown in FIG. 1, the slip set screw tip portion 70 is cylindrical having a diameter that is smaller than the diameter of the slip set screw body portion. Consequently, an annular shoulder 80 is defined on the body portion surrounding the tip portion. An annular groove 82 is formed on the body portion proximate the tip portion of each slip set screw. A seal 84, as for example an O-ring seal is fitted within that groove. Alternatively, an annular groove is formed on the fourth section of each opening accommodating a slip set assembly and a seal is fitted in such groove.

An annular spacer 86 is coupled to the intermediate portion 76 of each slip set screw. The spacer has an outer diameter that is greater than the inner diameter of the central opening 52 of the packing nut. In this regard, as the slip screw is threaded into the packing nut, the spacer engages the outer surface of the packing nut head 50 so as to limit the radially inward travel of the slip set screw. In the exemplary embodiment shown in FIG. 1, when the spacer engages the packing nut head, the entire tip portion 70 of the slip set screw extends within the axial passage 20 of the body while the slip screw body portion 72 remains within its corresponding second set radial opening 30.

Figure 2:
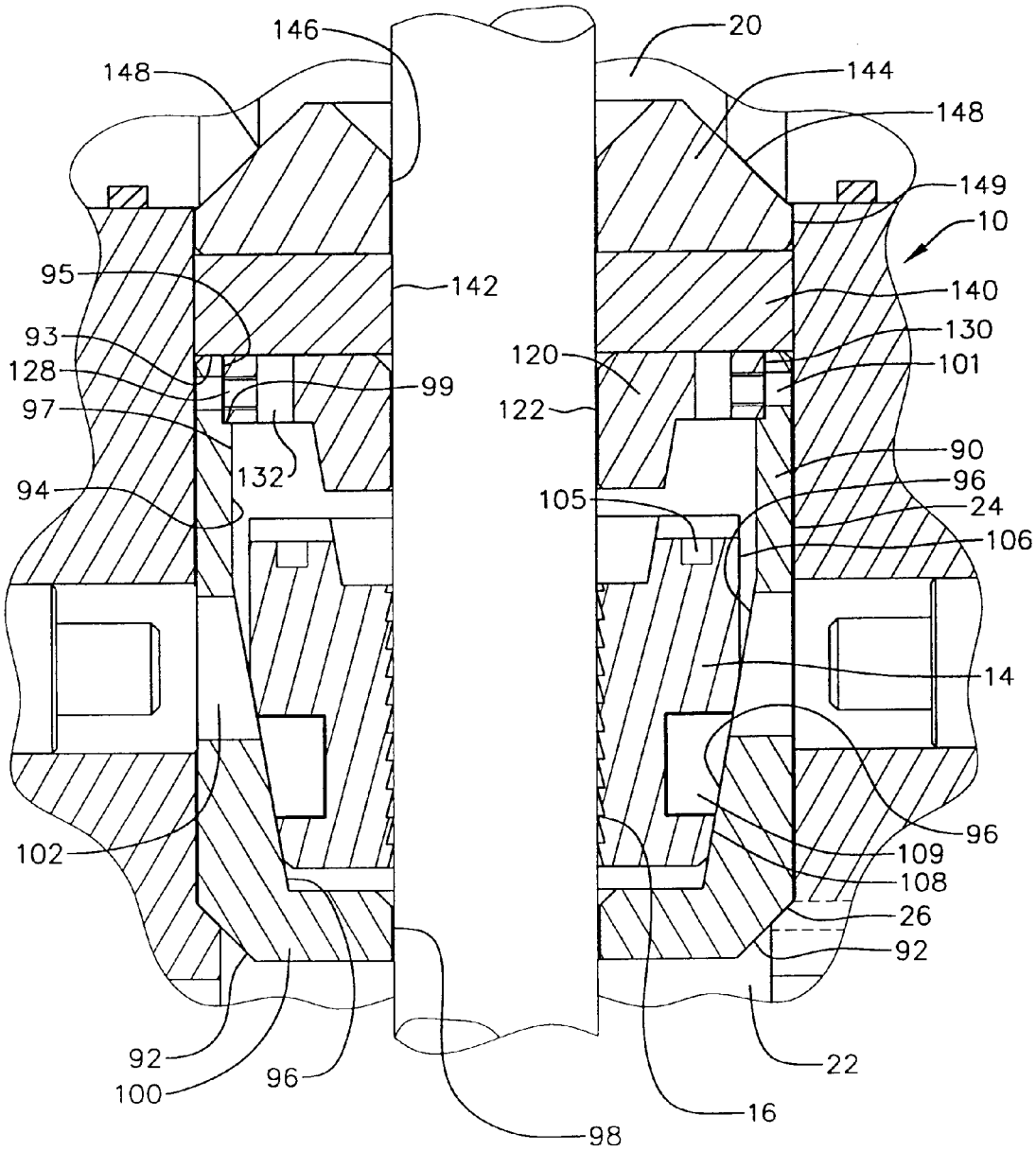
FIG. 2 is an enlargement of a cross-sectional view of the the slip bowl assembly portion of the system shown in FIG. 1.

A slip bowl 90 is fitted within the axial central cylindrical passage 20 formed on the body. The slip bowl has an outer diameter that is slightly smaller than the inner diameter of the upper section 24 but greater than the inner diameter of the lower section 22 of the cylindrical passage (FIGS. 1 and 2). Moreover, in the exemplary embodiment shown in FIG. 2, a lower edge 92 of the bowl is tapered at an angle complementary to the tapered angle of the taper formed on the section 26 between the two axial passage sections. In this regard, as the slip bowl is fitted into the passage, its tapered edge 92 rests against the tapered section 26 of the cylindrical passage preventing the slip bowl from further downward travel. The slip bowl is hollow on the inside having an open top. The interior defines a bowl that has a cylindrical section 94 from which extends a tapered or conical section 96. The cylindrical section has a first cylindrical portion 95 beginning at an end 93 of the bowl opposite a base 100 of the bowl. A second cylindrical portion 97 extends from the first portion having a diameter smaller than the first portion. An annular shoulder 99 is defined between the two cylindrical portions. In the exemplary bowl shown in FIGS. 1 and 2, radial openings 101 are formed through the first cylindrical portion 95. An opening 98 is formed through the base 100 of the bowl.

Openings 102 are formed radially through the bowl. In the exemplary embodiment shown in FIG. 1, the number of radial openings is equal to the number of slip set screws incorporated in the body. Furthermore, in the shown exemplary embodiment, the radial openings have a diameter greater than the diameter of the slip set screws tip portion but smaller than the diameter of the slip set screw bodies. Moreover, these openings are aligned and are set at a height such that when the bowl is seated against the tapered section of the central passage of the body, each such radial opening can be penetrated by a tip portion of a slip set screw as for example shown in FIG. 1.

The slip 14 is fitted within the slip bowl. In the exemplary embodiment, the slip is an annular structure and may comprise a single annular member, as for example shown in FIGS. 1 and 2, or it may consist of multiple annular members which together define an annular structure. The slip outer surface has a cylindrical upper section 106 and a tapering lower section 108. The tapering lower section is tapered such that it is complementary to the tapered section 96 of the slip bowl. Similarly, the cylindrical section of the slip is complementary to the cylindrical section 94 of the slip bowl. The slip is shorter in length than the depth of the slip bowl. In this regard, the slip can move up and down within the bowl. In the exemplary embodiment shown in FIG. 1, at least two threaded openings 105 are formed axially through the top end of the slip.

The slip has teeth 16 formed on its inner surface. Transverse depressions 109 radially extend from the outer surface of the slip radially inward. In the exemplary embodiment shown in FIGS. 1 and 2, these depressions are formed on the tapered section of the slip. These depressions are sized to accommodate the tip portion of the slip set screws and are small enough to preclude penetration of the body of the slip set screws. In the shown exemplary embodiment, the number of depressions is equal to the number of slip set screws. Furthermore, the depressions can be aligned with the slip set screws such that each depression can be penetrated by a slip set screw tip portion when the slip is located proximate the top portion of the bowl. In an alternate embodiment, instead of multiple depressions, an annular groove may be formed surrounding the slip. In such case, the width of the groove is preferably greater than the diameter of the tip portion of the slip set screws but smaller than the body portion of the slip set screws.

The coil tubing is fitted through the central passage and through the slip bowl and through the opening 98 at the base of the slip bowl. The teeth 16 formed on the inner surface of the slip can bite onto the outer surface of the tubing.

An annular top ring 120 is fitted over the slip bowl. The top ring has a central opening 122 having a diameter slightly greater than the outer surface diameter of the coil tubing. In the exemplary embodiment shown in FIGS. 1 and 2, the diameter of the top ring is slightly smaller than the diameter of the slip bowl first cylindrical portion 95 and greater than the slip bowl second cylindrical portion. In this regard, the top ring can fit within the slip bowl first cylindrical portion and sit on the annular shoulder 99 formed between the two bowl cylindrical portions. Threaded radial openings 128 are formed through a peripheral surface 130 of the top ring and are aligned with the radial openings 101 formed through the slip bowl first cylindrical portion 95. At least two axial openings 132 are also formed through the top ring and are positioned so as to be aligned with the axial threaded openings 105 formed on the slip.

An annular seal ring 140, preferably made from rubber is fitted over the top ring in surrounding relationship to the tubing. The annular seal ring has an inner opening 142 having a diameter that is slightly greater than the outer surface diameter of the coil tubing and an outer diameter that is slightly smaller than the body axial passage upper section 24 diameter. A top packing ring 144 is fitted over the annular seal ring. The top packing ring 144 also has an inner surface 146 having a diameter that is slightly greater than the outer surface diameter of the coil tubing and an outer surface 149 having a diameter that is slightly smaller than the diameter of the upper section 24 of the central passage of the body 20. A portion 148 of an upper surface of the top packing ring tapers upward in a radially inward direction.

A flow tee 150 is coupled to an upper end of the body as shown in FIG. 1. In the exemplary embodiment shown in FIG. 1, studs 152 extend from the body and penetrate openings 154 formed on a flange 156 extending from the flow tee. Nuts 158 are threaded on the studs for retaining the flow tee against the body. A seal 160 may be sandwiched between the body and the flow tee in surrounding relationship to the central axial passage 20. In the exemplary embodiment shown in FIG. 1, studs 162 extend from the lower end of the body for coupling the body to a hanger, for example, a rotating hanger to form a tree.

Figure 3:
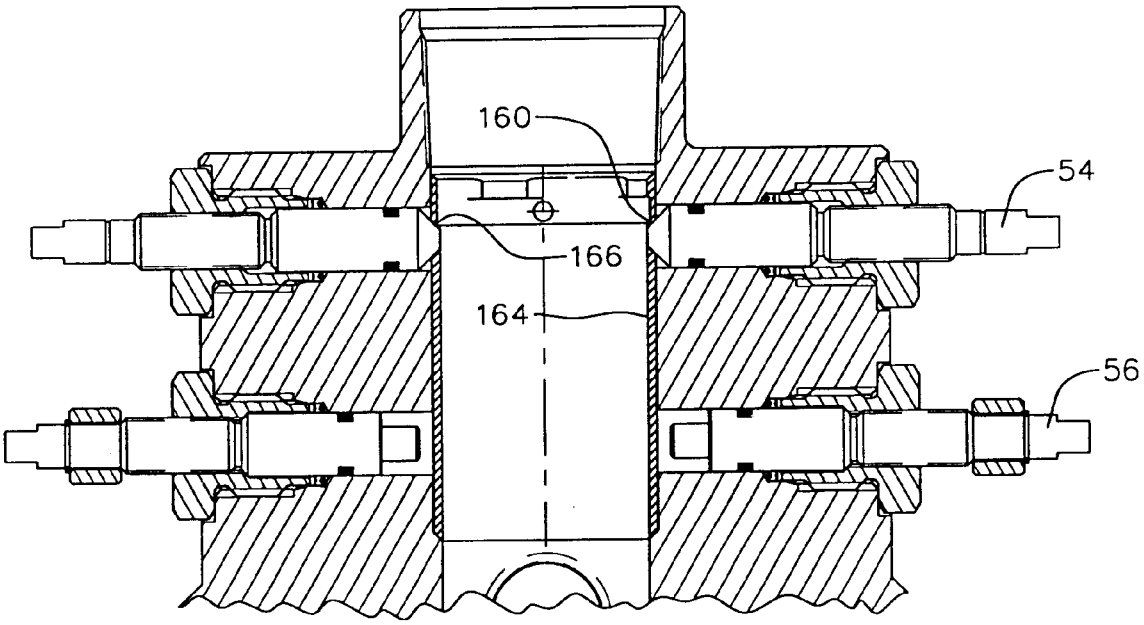
FIG. 3 is a partial cross-sectional view of the coil tubing head body shown in FIG. 1 with an installed wear bushing.

An exemplary installation of the tubing head system disclosed herein is as follows. First a master valve (not shown) is closed, and the tubing head 10 is mounted onto the master valve, as for example, by use of the studs 162 extending from the lower end of the tubing head. Once installed on the master valve, the energizing screws 54 and slip set 56 screws are backed off until they stop against their corresponding packing nuts. A wear bushing 164 is then installed into the tubing head body central passage (FIG. 3). The wear bushing has alignment holes 166 and these holes are aligned with the energizing screws 54 in the body of the tubing head. The alignment holes in the wear bushing have a diameter that is smaller than the diameter of the body portion of the energizing screws such that they can be slightly penetrated by the tip portions of the energizing screws. The energizing screws should be engaged into the wear bushing alignment holes without excessive force as to not distort the wear bushing. The master valve may then be opened and the drilling operations may continue through the tubing head as needed. After the drilling operations are complete, the master valve is closed and the drilling equipment is removed. The energizing screws are then backed off until they stop against the packing nuts and the wear bushing is removed, as for example, by using a wear bushing retrieval tool.

Figure 4:
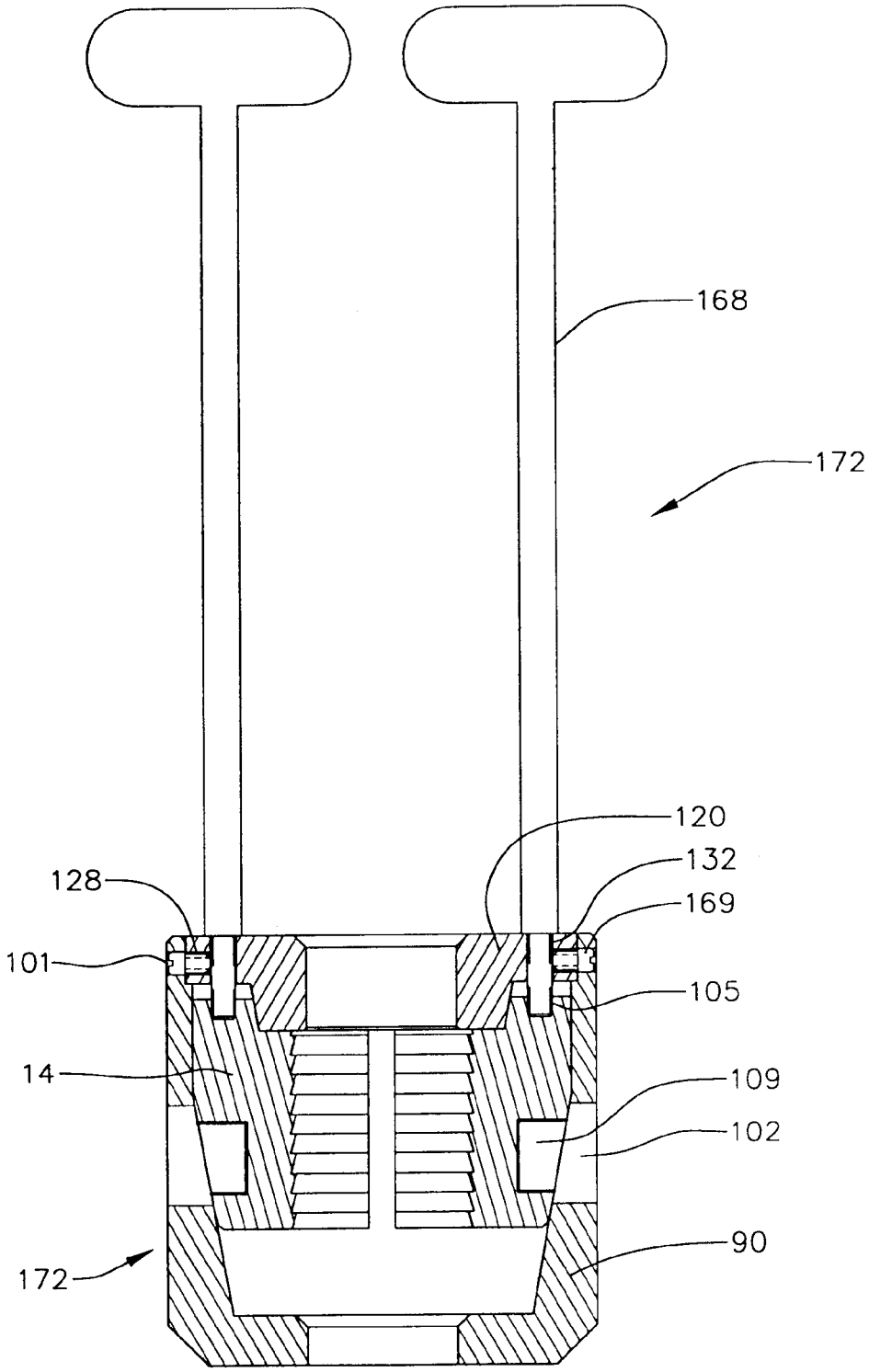
FIG. 4 is a partial cross-sectional view of a slip bowl assembly shown in FIG. 1 with mounted running tubes.

Threaded running tubes 168 are fitted through the axial openings 132 on the top ring and thread into the corresponding openings 105 formed on the slip (FIG. 4). When the running tubes are threaded through the slip 14, the slip is maintained against the top ring. The slip 14 with fastened top ring 120 are then placed in the slip bowl 90 aligning the radial openings 101 formed on the slip bowl with the radial openings 128 formed on the top ring. Fasteners, so for example fasteners 169, are fitted through the slip bowl radial openings 101 and threaded through the top ring radial openings 128. When this occurs, the depressions 109 formed on the slip are aligned with the openings 102. The slip bowl, slip, top ring and running tubes form a bowl assembly 172 that can be moved by moving the running tubes.

Figure 5:
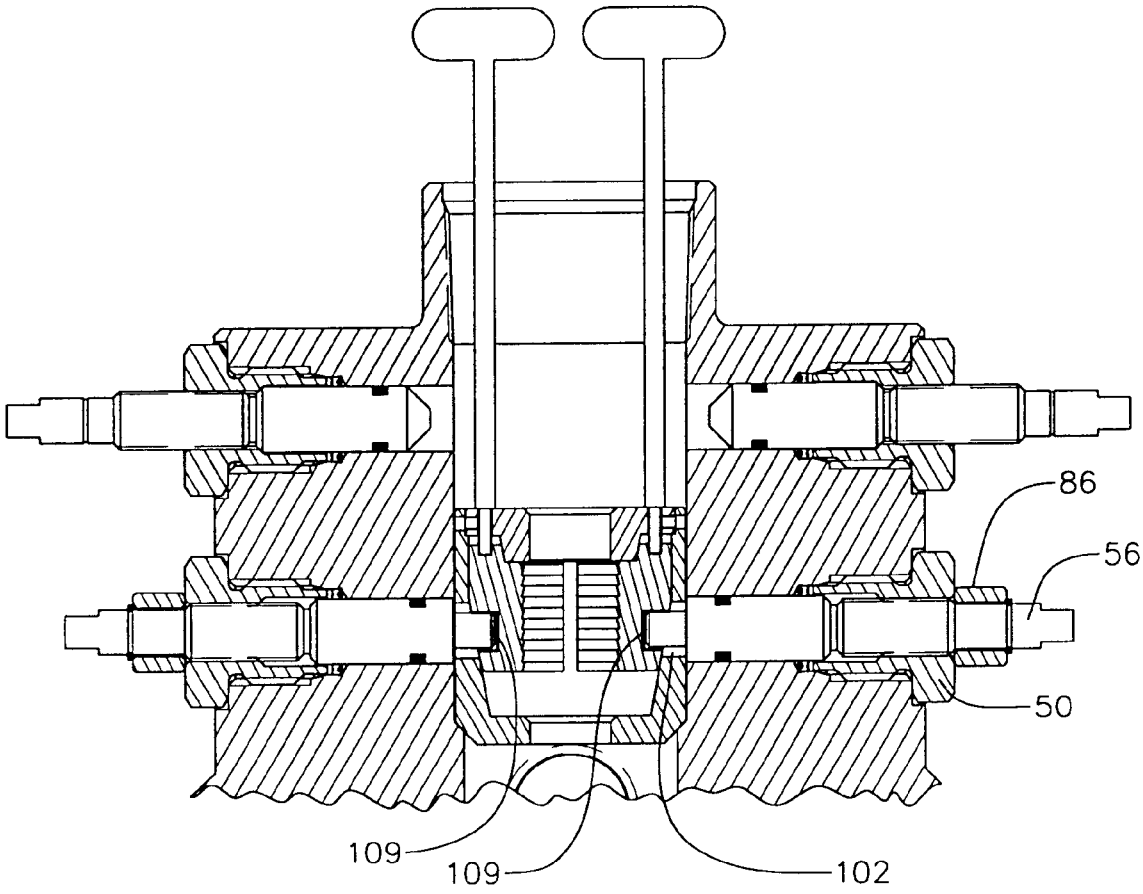
FIG. 5 is a partial cross-sectional view depicting the slip bowl shown in FIG. 1 assembly being fitted within the coil tubing head.
Figure 6:
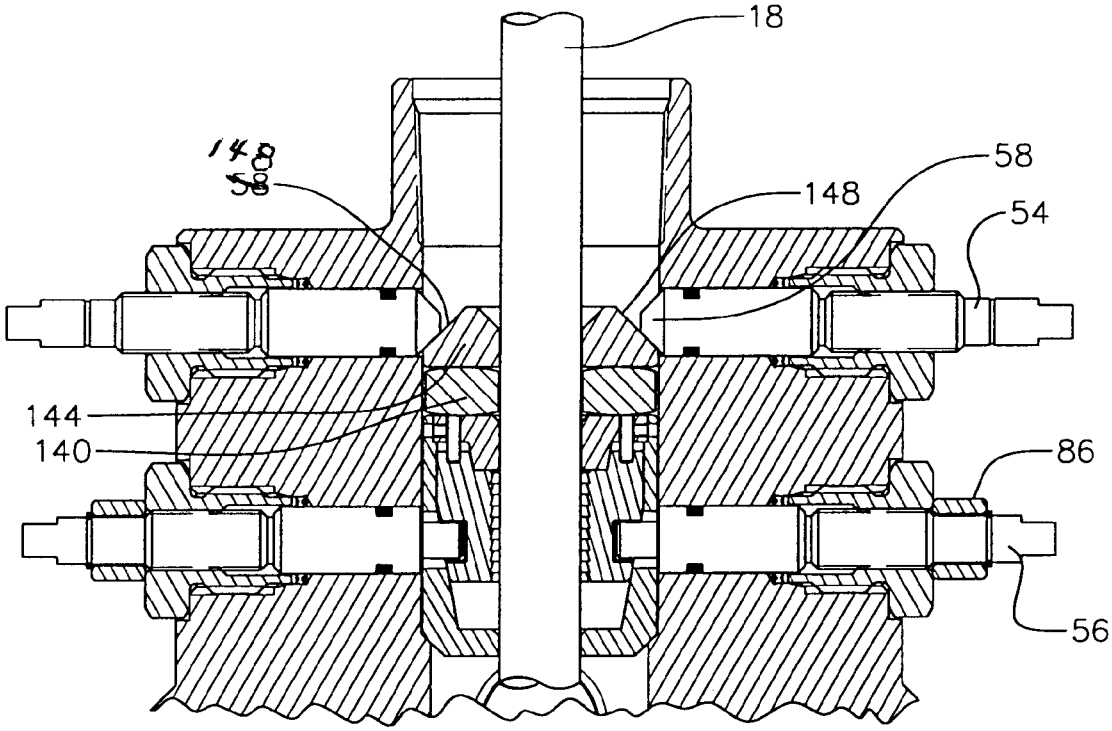
FIG. 6 is a cross-sectional view of the tubing head body shown in FIG. 1 with into fitted the bowl assembly including the seal ring and top ring.

The bowl assembly 172 is lowered into the central axial passage 20 of the body by use of the running tubes such that the bowl tapered surface 92 rests against the tapered section 26 formed on the central axial passage of the body as shown in FIG. 5. When that occurs, the radial openings 102 through the slip bowl and slip depressions 109 are aligned with the slip set screws 56. The slip set screws are threaded through their corresponding packing nuts such that their tip portions 70 penetrate through the radial openings formed on the slip bowl and into the slip depressions 109 as shown in FIG. 5. When proper penetration has occurred, the spacer 86 of the slip set screw rests against its corresponding packing nut head 50.

The threaded running tubes are then removed and the slip is maintained in an up position relative to the slip bowl by the slip set screws as shown in FIG. 5. The annular seal ring 140 is then installed on top of the top ring. The top packing ring 144 is then installed on top of the annular seal ring with the tapered section of the top packing ring facing away from the slip bowl. The energizing screws are then slightly threaded such that the tapered surface of the frusto-conical tip portions 58 of the energizing screws bear against the tapered upper surface portion 148 of the packing ring without energizing the seal ring, thus preventing the engagement of the axial passage 20 by the seal ring. The coil tubing 18 is then installed.

Figure 7:
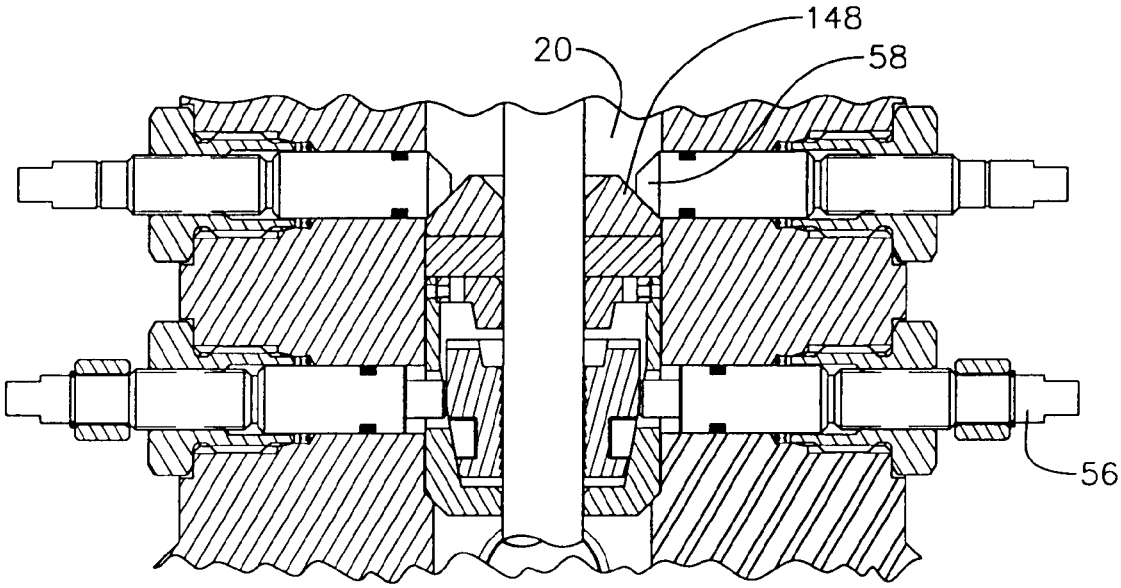
FIG. 7 is a partial cross-sectional view of the hanger system of FIG. 1 with the seal ring energized.

When the coil tubing is up the desired depth, the slip set screws are backed off until they stop against the packing nuts as shown in FIG. 7. The slip will then ramp down due to gravity and bite with its teeth 16 onto the coil tubing. If need be, the coil tubing may be vibrated to help seat the slip on onto the tubing. The seal energizing screws are then threaded into their corresponding packing nuts alternating one turn per screw causing their frusto-conical tip portions 58 to engage the tapered upper surface 148 of the top packing ring causing the top packing ring to exert a force against the seal ring which expands radially providing a seal against the body axial passage 20. Once the well is fully contained, the coil tubing may be cut above the top of the tubing head and beveled and the flow tee 150 is installed. The slip set screws 56 can now be re-energized so that their tip portion engages the outer surface of the slip to create a manual set of the slip onto the coil tubing to prevent vertical movement as shown in FIG. 7. The seals may be tested through a test port (not shown) that is typically provided radially through the upper portion of the body and located above the slip bowl. Although the present invention has been described and illustrated to respect multiple embodiments thereof, it is to be understood that it is not to be so limited, since changes and modifications may be made therein which are within the full intended scope of this invention as hereinafter claimed.

What is claimed is:

1. A coil tubing hanger system comprising:

a body having an opening there through;

a shoulder formed within the opening;

a slip bowl fitted within the opening and resting against the shoulder, the bowl comprising a base portion having an opening there through and a peripheral portion, wherein a portion of an inner surface of the peripheral portion tapers from a larger diameter to a smaller diameter in a direction toward the shoulder;

a slip fitted within the slip bowl, the slip having an inner surface, an outer surface and at least one depression formed on its outer surface, wherein the slip can move between a first position further from the base portion to a second position proximate the base portion, wherein the slip surrounds at least a portion of a cylindrical space aligned with the opening formed through the bowl base portion;

a plurality of slip set screws fitted radially through the body, wherein each screw comprises a tip portion that can extend within the cylindrical opening;

at least one opening formed on the bowl and in communication with the at least one depression of the slip, wherein the tips of said slip screws can penetrate the at least one opening and the at least one depression for maintaining said slip in the first position; and a packing ring fitted within the body cylindrical opening and over the bowl, wherein the packing ring has an opening axially aligned with the opening on the bowl base and wherein the outer diameter of the packing ring is greater than the inner diameter of peripheral portion of the bowl.

2. A system as recited in claim 1 further comprising teeth formed on the inner surface of the slip.

3. A system as recited in claim 2 wherein the outer surface of the slip is tapered axially forming a taper complementary to the taper of the portion of the inner surface of the bowl peripheral portion.

4. A system as recited in claim 3 wherein the slip comprises a plurality of separate slip portions, each slip portion defining an arc.

5. A system as recited in claim 1 further comprising a plurality of energizing screws fitted radially through the body, wherein said energizing screws comprise tips which can extend into the body cylindrical opening.

6. A system as recited in claim 5 wherein the packing ring comprises a face furthest from the bowl, wherein said face comprises an annular tapered portion tapering toward the bowl in a radially outward direction and wherein the energizing screw tips have a conical surface, and wherein the conical surfaces of said tips engage the tapered portion of the packing ring for urging the packing ring toward the bowl.

7. A system as recited in claim 6 further comprising a top ring having a central opening fitted within the bowl between the slips and the packing ring.

8. A system as recited in claim 7 further comprising seal ring comprising a central opening, said seal ring fitted between the packing ring and the top ring.

9. A method for installing a coil tubing hanger system comprising the steps of:

installing a coil tubing head body on a master valve, wherein the body comprises an axial passage having an annular shoulder formed therein, a first set of openings and second set of openings above the first set of opening, wherein each of the openings of said first and second set provide access from an outer surface of the body to the axial passage;

mounting a slip bowl within the passage in the annular shoulder, the slip bowl having a plurality of transverse openings, a mouth, a base opposite the mouth and an end opening through the base, wherein said plurality of bowl transverse openings are aligned with the first set, and wherein the bowl comprises an inner surface comprising an inner portion that tapers to smaller diameter in a direction toward the bowl base;

fitting a slip within the slip bowl the slip having an outer surface and an inner surface, wherein the slip comprises at least a depression formed on its outer surface, wherein the slip can slide axially within the bowl between a first position proximate the mouth and second position distal from the mouth, wherein when in the first position the depression is aligned with at least one of said slip bowl openings, and wherein the slip inner surface comprises a plurality of teeth;

fitting a slip screw within a first set opening, said slip screw comprising a tip portion; wherein the tip portion penetrates through a slip bowl transverse opening and into the slip depression for maintaining the slip in the first position.

10. A method as recited in claim 9 further comprising the steps of:

seating a top ring on the open end of the bowl;

placing a seal ring over the top ring; and placing a top packing ring over the seal ring, wherein the top packing ring comprises a first annular surface opposite a second annular surface, wherein the first annular surface faces the seal ring.

11. A method as recited in claim 10 further comprising the steps of:

placing a tubing through the top packing ring, the seal ring, the top ring, the slip and the bowl;

fitting an energizing screw through each of the second set of transverse openings, each energizing screw comprising a tip portion engaging the top ring second annular surface.

12. A method as recited in claim 11 wherein the top packing ring second annular surface comprises a tapered portion tapering tapers in a radially outward direction and in a direction toward the first annular surface, and wherein each energizing screw tip portion comprises a frusto-conical surface for engaging the second annular surface tapering portion.

13. A method as recited in claim 12 further comprising the step of backing off the slip for withdrawing the tips of the slip set screws from the slip depression allowing the slip to slide to a second position and the teeth formed on the slip inner surface to bite on the tubing.

14. A method as recited in claim 13 further comprising the step of threading the energizing screws such that their tip portions engage the second annular surface tapered portion exerting a force against the seal ring and energizing said seal ring.

15. A method as recited in claim 14 further comprising the step of threading the slip set screws such that their tip portions engage the outer surface of the slip.

16. A method as recited in claim 9 wherein the slip comprises a plurality of separate axial sections.

17. A method for installing a coil tubing hanger system comprising the steps of:

installing a coil tubing head body on a master valve, wherein the body comprises an axial passage forming an annular shoulder therein, a first set of openings and second set of openings above the first set of opening, wherein each of the openings of said first and second set provide access from an outer surface of the body to the axial passage;

fitting a slip within a slip bowl, wherein the slip bowl comprises the slip bowl a plurality of transverse openings, a mouth, a base opposite the mouth and an end opening through the base, wherein the bowl comprises an inner surface comprising an inner portion that tapers to smaller diameter in a direction toward the bowl base, wherein the slip comprises an outer surface and an inner surface, wherein the slip comprises at least a depression formed on its outer surface, wherein the slip can slide axially within the bowl between a first position proximate the mouth and second position distal from the mouth, wherein when in the first position the depression is aligned with at least one of said slip bowl openings, and wherein the slip inner surface comprises a plurality of teeth;

attaching a top ring to the bowl open end having an axial opening;

fastening a member to the slip, said member penetrating the axial opening of the top ring; wherein when the member retains the slip in the first position and wherein the bowl, slip and top ring form an assembly;

seating the assembly within the passage annular shoulder with the top ring located further from the annular shoulder;

fitting a slip screw within a first set opening, said slip screw comprising a tip portion; wherein the tip portion penetrates through a slip bowl transverse opening and into the slip depression for maintaining the slip in the first position;

placing a seal ring over the top ring; and placing a top packing ring over the seal ring, wherein the top packing ring comprises a first annular surface opposite a second annular surface, wherein the first annular surface faces the seal ring;

placing a tubing through the top packing ring, the seal ring, the top ring, the slip and the bowl;

fitting an energizing screw through each of the second set of transverse openings, each energizing screw comprising a tip portion engaging the top ring second annular surface;

backing off the slip for withdrawing the tips of the slip set screws from the slip depression allowing the slip to slide to a second position and the teeth formed on the slip inner surface to bite on the tubing; and threading each energizing screw such that its tip portion engages the top ring second annular surface.

18. A method as recited in claim 17 wherein the top packing ring second annular surface comprises a tapered portion tapering tapers in a radially outward direction and in a direction toward the first annular surface, and wherein each energizing screw tip portion comprises a frusto-conical surface for engaging the second annular surface tapering portion, and wherein the threading step comprises threading each energizing screw such that its tip frusto-conical portion engages the top ring second annular surface tapered portion exerting a force on the top ring and against the seal ring for energizing the seal ring.

19. A method as recited in claim 18 further comprising the step of threading the slip set screws such that their tip portions engage the outer surface of the slip.

20. A method as recited in claim 17 wherein the slip comprises a plurality of separate axial sections.

* * * * *